US008827315B2

(12) United States Patent
Waumans et al.

(10) Patent No.: US 8,827,315 B2
(45) Date of Patent: Sep. 9, 2014

(54) SECURITY DOCUMENT WITH SECURITY FEATURE ON EDGE

(75) Inventors: Bart Waumans, Puurs (BE); Ingrid Geuens, Emblem (BE)

(73) Assignee: Agfa-Gevaert N.V., Mortsel (BE)

( * ) Notice: Subject to any disclaimer, the term of this patent is extended or adjusted under 35 U.S.C. 154(b) by 48 days.

(21) Appl. No.: 13/509,509

(22) PCT Filed: Dec. 9, 2010

(86) PCT No.: PCT/EP2010/069299

§ 371 (c)(1),
(2), (4) Date: May 11, 2012

(87) PCT Pub. No.: WO2011/070122

PCT Pub. Date: Jun. 16, 2011

(65) Prior Publication Data

US 2012/0223516 A1 Sep. 6, 2012

Related U.S. Application Data

(60) Provisional application No. 61/286,389, filed on Dec. 15, 2009.

(30) Foreign Application Priority Data

Dec. 10, 2009 (EP) ..... 09178678

(51) Int. Cl.
*B42D 15/10* (2006.01)

(52) U.S. Cl.
CPC ..... *B42D 15/10* (2013.01); *B42D 2033/20* (2013.01); *B42D 2033/22* (2013.01); *B42D 2035/16* (2013.01); *Y10S 283/904* (2013.01)
USPC ..... 283/114; 283/904; 283/107; 235/489

(58) Field of Classification Search
CPC ..... B42D 2035/44; B42D 2033/22
USPC ..... 283/107, 114, 904; 235/489
See application file for complete search history.

(56) References Cited

U.S. PATENT DOCUMENTS 1,861,663 A * 6/1932 Lahey ..... 428/492
2,330,718 A * 9/1943 Kallmann ..... 283/90

(Continued)

FOREIGN PATENT DOCUMENTS

AU 42586/89 4/1991
DE 3812454 10/1989

(Continued)

OTHER PUBLICATIONS

EP Search Report for EP07116829.8, Aug. 20, 2008, 5 pp.

(Continued)

*Primary Examiner* — Kyle Grabowski
(74) *Attorney, Agent, or Firm* — Leydig, Voit & Mayer, Ltd.

(57) ABSTRACT

A security document precursor including one or more lamellae provided with two or more holes near a perimeter edge surface of the precursor, wherein the holes perforate the largest surface of the one or more lamellae, and wherein at least one of the holes is filled with a colored material which differs in color from at least one of the one or more lamellae, such that the colored material is visible from a direction perpendicular on the perimeter edge surface; wherein at least one of the one or more lamellae is transparent or translucent: or wherein at least one of the one or more lamellae is opaque and the opaque part of the at least one of the one or more lamellae between the perimeter edge and the hole filled with a colored material has been removed. A security document and a method of preparing the security document precursor are also disclosed.

15 Claims, 3 Drawing Sheets

(56) References Cited

U.S. PATENT DOCUMENTS

| | | | | |
|---|---|---|---|---|
| 3,479,426 | A | 11/1969 | De Smedt | |
| 3,578,845 | A | 5/1971 | Brooks et al. | |
| 3,604,901 | A * | 9/1971 | Morita et al. | 235/489 |
| 3,867,148 | A | 2/1975 | O'Keeffe et al. | |
| 3,918,976 | A | 11/1975 | Arai et al. | |
| 4,082,901 | A | 4/1978 | Laridon et al. | |
| 4,096,933 | A | 6/1978 | Massa | |
| 4,223,918 | A | 9/1980 | Smoczynski | |
| 4,352,716 | A | 10/1982 | Schaible et al. | |
| 4,450,024 | A | 5/1984 | Haghiri-Tehrani et al. | |
| 4,480,177 | A | 10/1984 | Allen | |
| 4,506,916 | A | 3/1985 | Kuhl | |
| 4,544,181 | A | 10/1985 | Maurer et al. | |
| 4,552,383 | A | 11/1985 | Hoppe et al. | |
| 4,556,628 | A | 12/1985 | Greschner et al. | |
| 4,853,300 | A | 8/1989 | Pike | |
| 4,856,857 | A | 8/1989 | Takeuchi et al. | |
| 4,913,858 | A | 4/1990 | Miekka et al. | |
| 5,142,383 | A | 8/1992 | Mallik | |
| 5,145,212 | A | 9/1992 | Mallik | |
| 5,164,227 | A | 11/1992 | Miekka et al. | |
| 5,171,625 | A | 12/1992 | Newton | |
| 5,223,081 | A | 6/1993 | Doan | |
| 5,407,893 | A | 4/1995 | Koshizuka et al. | |
| 5,527,758 | A | 6/1996 | Uyttendaele et al. | |
| 5,589,317 | A | 12/1996 | Defieuw et al. | |
| 5,753,352 | A | 5/1998 | Vanmaele et al. | |
| 5,804,026 | A | 9/1998 | Vogt | |
| 5,863,859 | A | 1/1999 | Uytterhoeven et al. | |
| 5,869,140 | A | 2/1999 | Blohowiak et al. | |
| 6,090,747 | A | 7/2000 | Dronzek | |
| 6,210,777 | B1 | 4/2001 | Vermeulen et al. | |
| 6,254,971 | B1 | 7/2001 | Katayose et al. | |
| 6,283,378 | B1 | 9/2001 | Welling | |
| 6,328,342 | B1 | 12/2001 | Belousov et al. | |
| 6,514,367 | B1 | 2/2003 | Leighton | |
| RE38,321 | E | 11/2003 | Uyama et al. | |
| 6,693,657 | B2 | 2/2004 | Carroll, Jr. et al. | |
| 6,786,513 | B1 * | 9/2004 | Cobben et al. | 283/904 |
| 6,803,114 | B1 | 10/2004 | Vere et al. | |
| 7,097,899 | B2 | 8/2006 | Daems et al. | |
| 7,541,088 | B2 | 6/2009 | Bennett et al. | |
| 8,226,014 | B2 * | 7/2012 | Kluge | 235/489 |
| 2001/0016426 | A1 | 8/2001 | Lee et al. | |
| 2002/0136582 | A1 | 9/2002 | Verdyck | |
| 2003/0068491 | A1 | 4/2003 | Otaki et al. | |
| 2003/0075275 | A1 | 4/2003 | Kubota | |
| 2003/0183695 | A1 | 10/2003 | Labrec et al. | |
| 2004/0007324 | A1 | 1/2004 | Henn et al. | |
| 2004/0180520 | A1 | 9/2004 | Janke | |
| 2005/0001419 | A1 * | 1/2005 | Levy et al. | 283/904 |
| 2005/0087606 | A1 * | 4/2005 | McCumber | 235/491 |
| 2006/0127623 | A1 | 6/2006 | Ishida | |
| 2006/0177637 | A1 * | 8/2006 | Kimura | 428/195.1 |
| 2006/0193021 | A1 | 8/2006 | Ishimoto et al. | |
| 2006/0216872 | A1 | 9/2006 | Arai et al. | |
| 2007/0017647 | A1 | 1/2007 | Habik et al. | |
| 2007/0026585 | A1 | 2/2007 | Wong et al. | |
| 2008/0318073 | A1 | 12/2008 | Klein et al. | |
| 2009/0187435 | A1 | 7/2009 | Carr et al. | |
| 2010/0164220 | A1 * | 7/2010 | Kaskiala | 283/107 |
| 2010/0201115 | A1 | 8/2010 | Geuens | |
| 2011/0204616 | A1 | 8/2011 | Geuens | |
| 2011/0266788 | A1 | 11/2011 | Geuens | |

FOREIGN PATENT DOCUMENTS

| | | | |
|---|---|---|---|
| DE | 102007037982 | | 2/2009 |
| EP | 0544035 | | 6/1993 |
| EP | 0552656 | | 7/1993 |
| EP | 0622217 | | 11/1994 |
| EP | 0761468 | | 3/1997 |
| EP | 0792756 | | 9/1997 |
| EP | 0866750 | | 9/1998 |
| EP | 1170630 | | 1/2002 |
| EP | 1632362 | | 3/2006 |
| EP | 1852269 | | 11/2007 |
| EP | 1852270 | | 11/2007 |
| EP | 2042576 | | 4/2009 |
| GB | 838708 | | 6/1960 |
| GB | 1439478 | | 6/1976 |
| GB | 2132136 | | 7/1984 |
| GB | 2279610 | | 1/1995 |
| GB | 2338678 | | 12/1999 |
| GB | 2400074 | | 10/2004 |
| JP | 58-172676 | | 10/1983 |
| JP | 63-215732 | | 9/1988 |
| JP | 03-270993 | | 12/1991 |
| JP | 04-123191 | | 4/1992 |
| JP | 07-089225 | | 4/1995 |
| JP | 08-300810 | | 5/1998 |
| JP | 10-119163 | | 5/1998 |
| JP | 00-085282 | | 3/2000 |
| JP | 00-251108 | | 9/2000 |
| JP | 05-293396 | | 10/2005 |
| JP | 07-268712 | | 10/2007 |
| WO | WO 99/24934 | | 5/1999 |
| WO | WO 99/51446 | | 10/1999 |
| WO | WO 00/18591 | | 4/2000 |
| WO | WO 01/54917 | | 8/2001 |
| WO | WO 03/055638 | | 7/2003 |
| WO | WO 02/074548 | | 9/2006 |
| WO | WO 2007/023410 | | 3/2007 |
| WO | WO 2007/027619 | | 3/2007 |
| WO | WO 2007/132214 | | 11/2007 |
| WO | WO 2008/074548 | A1 | 6/2008 |
| WO | WO 2008/084315 | | 7/2008 |
| WO | WO 2008/110892 | | 9/2008 |
| WO | WO 2009/037330 | | 3/2009 |
| WO | WO 2009/063058 | A1 | 5/2009 |
| WO | WO 2011/073383 | | 6/2011 |
| WO | WO 2011/073384 | | 6/2011 |

OTHER PUBLICATIONS

EP Search Report for EP08172496.5, Feb. 25, 2009, 6 pp.
Int'l Search Report for PCT/EP2008/062501, Jan. 7, 2009, 2 pp.
Int'l Search Report for PCT/EP2008/062512, Jan. 26, 2009, 2 pp.
Int'l Search Report for PCT/EP2009/053905, Jul. 15, 2009, 4 pp.
Int'l Search Report for PCT/EP2009/065882, Feb. 15, 2010, 4 pp.
Int'l Search Report for PCT/EP2010/069299, Apr. 8, 2011, 2 pp.
Int'l Search Report for PCT/EP2010/070064, Apr. 8, 2011, 3 pp.
Int'l Search Report for PCT/EP2010/070065, Apr. 7, 2011, 2 pp.
"Adhesion and Bonding," *Encyclopedia of Polymer and Engineering*, Mark et al., ed., pp. 476-577 (1985).
International Preliminary Report on Patentability in corresponding International Patent Application No. PCT/EP2010/069299, mailed Jun. 12, 2012.

* cited by examiner

SECURITY DOCUMENT WITH SECURITY FEATURE ON EDGE

CROSS-REFERENCE TO RELATED APPLICATIONS

This patent application is the U.S. national stage of International Patent Application No. PCT/EP2010/069299, filed Dec. 9, 2010, which claims the benefit of European Patent Application No. 09178678.0, filed Dec. 10, 2009, and of U.S. Provisional Patent Application No. 61/286,389, filed Dec. 15, 2009, the disclosures of which are herein incorporated by reference.

TECHNICAL FIELD

This invention relates to security documents having security features near the perimeter edge surface of the document and methods for providing them.

BACKGROUND ART

Security cards are widely used for various applications such as identification purposes (ID cards) or financial transfers (credit cards). Such cards typically consist of a laminated structure consisting of various plastic lamellae and layers wherein one or more of them carry information, e.g. alphanumeric information, logos, a picture of the card holder, etc.

Writable cards wherein the user can store digital information are also known, e.g. cards comprising a magnetic strip, optically recordable cards or cards comprising an electronic chip, sometimes called 'smart cards'.

A principal objective of security cards is that it cannot be easily modified or reproduced in such a way that the modification or reproduction is difficult to distinguish from the original. Therefore security features, e.g. a hologram, are usually positioned on the front or the back of a security card, rather than on the thin edge.

WO 2008/110892 (SETEC) discloses an identification document comprising at least two constitution layers, wherein at least one edge of the identification document is marked with written data that are etched into the edge by means of a laser beam. The written data overlap with constitution layers, in order to prevent a fraudulent delamination of the document. Such laser marking involves the carbonization of material, e.g. polycarbonate, whereby the colour of the written data is always black. Hence, it is not possible to provide data marked in a colour different from black on the edge of the identification document.

Coloured markings on the edge of a security card can be provided by printing techniques such as, for example, inkjet printing. US 2005087606 A (DATACARD) discloses a card having non-visible or visible communication markings printed on the perimeter edge surface of the card using an ink-jet printer. The markings, e.g. lines of a barcode, are generally printed on the perimeter edge surface in a direction perpendicular on the longest side of the perimeter edge. It is very difficult to print a long straight line parallel with the longest side of the perimeter edge surface. Furthermore, the communication markings on the perimeter edge surface tend to suffer from wear and tear.

US 2009187435 discloses driver's licenses and other security documents including one or more machine-readable features which are encoded around the entire edge of the card using printing or laser engraving. Paragraphs [0090] to [0093] disclose that physical voids having a long lifetime may be created into the edge surface by laser engraving in order to increase the durability of the marking. These voids, penetrating the perimeter edge surface, may be filled with ink, or not.

DE 10 2007 037 982 A1 (Bundesdruckerei) and U.S. Pat. No. 6,328,342 disclose security documents having holes in the middle of a lamella, which can be filled with a colorant, but are only visible from the front or backside and not from the side.

Since methods for falsification and counterfeiting of security documents continue to develop and improve, it remains a constant battle to protect security documents against falsification and counterfeiting. Therefore a need exists to provide simple and cost-effective methods for securing documents. It would be desirable to be able to provide text matter in a different colour than black on the perimeter edge surface, which also does not suffer from wear and tear.

DESCRIPTION OF INVENTION

In order to overcome the problems described above, preferred embodiments of the present invention provide a security document precursor as defined by claim 1 which could be manufactured by a very simple method. The filled holes in the security document can be used to identify a genuine document.

It was also observed that the filled holes improved the adhesion between lamellae. This provides an unexpected advantage because often a card forgery is performed by the consecutive steps of delamination, alteration of information on the card, and relamination.

Further advantages and embodiments of the present invention will become apparent from the following description.

BRIEF DESCRIPTION OF DRAWINGS

Part a. of FIG. 1 shows the front view of a security document 1 which contains information 2 for identification of the card owner and holes 3 near the perimeter edge of the document. In part b. of FIG. 1, a side view, i.e. the perimeter edge surface 7 of the security document 1, is shown wherein the holes 3 are unfilled. In part c. of FIG. 1, the holes are filled with differently coloured matter 4, 5 and 6. If the coloured matter 4, 5 and 6 is black, respectively yellow and red, the Belgian flag is visible on the perimeter edge surface.

Parts a. to f.

DEFINITIONS

The definitions of security features correspond with the normal definition as adhered to in the "Glossary of Security Documents—Security features and other related technical terms" as published by the Consilium of the Council of the European Union on Aug. 31, 2009 (Version: v.09916.08.en) on its website: http://www.consilium.europa.eu/prado/EN/glossaryPopup.html.

The term "lamella", as used in disclosing the present invention, means a self-supporting polymeric sheet optionally provided with an adhesive system used in producing laminates using pressure optionally together with heat.

The term "layer" is considered not to be self-supporting and requires a lamella as a support.

"PET" is an abbreviation for polyethylene terephthalate.

"PETG" is an abbreviation for polyethylene terephthalate glycol, the glycol indicating glycol modifiers which are incorporated to minimize brittleness and premature aging that occur if unmodified amorphous polyethylene terephthalate (APET) is used in the production of cards.

"PET-C" is an abbreviation for crystalline PET, i.e. a biaxially stretched polyethylene terephthalate. Such a polyethylene terephthalate support has excellent properties of dimensional stability.

Security Document Precursors and Security Documents

A security document precursor according to the present invention includes one or more lamellae provided with two or more holes near a perimeter edge surface of the precursor, wherein the holes perforate the largest surface of the one or more lamellae, and wherein at least one of the holes is filled with a coloured material which differs in colour from at least one of the one or more lamellae, such that the coloured material is visible from a direction perpendicular on the perimeter edge surface.

In one embodiment of the security document precursor according to the present invention, at least one of the one or more lamellae is transparent or translucent. This allows the differently coloured holes to be directly visible from a direction perpendicular on the perimeter edge of the security document precursor.

Figure 5:
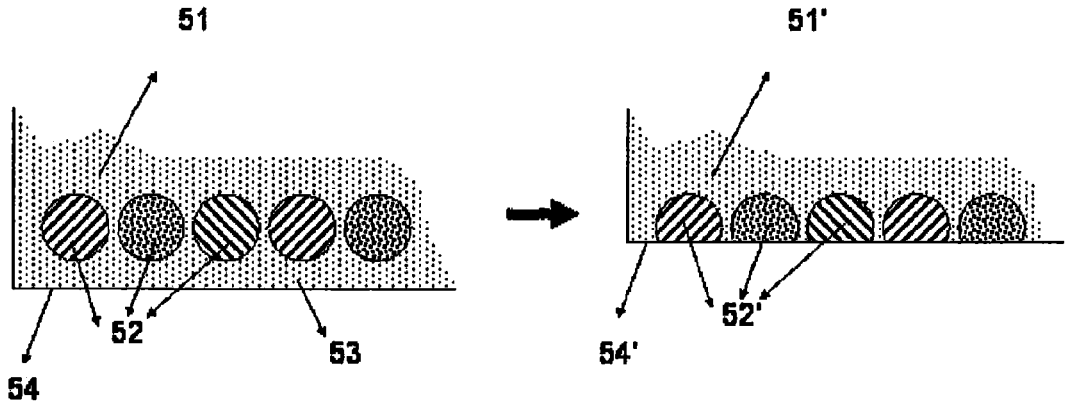
FIG. 5 shows on the left a partial top view of an opaque security document precursor 51 having differently colored holes 52 near the perimeter edge 54, but wherein the differently colored holes 52 are not visible from a direction perpendicular on the perimeter edge 54 due to the opaque part 53 of the security document precursor. On the right, the same partial top view of the opaque security document precursor 51' is shown wherein the opaque part 53 has been removed to form a new perimeter edge 54' which allows the differently colored holes 52' to be visible from a direction perpendicular on the new perimeter edge 54'.

In another embodiment of the security document precursor according to the present invention, at least one of the one or more lamellae is opaque and the opaque part of the at least one of the one or more lamellae between the perimeter edge and the hole filled with a coloured material has been removed, such that the coloured material in the holes becomes visible from a direction perpendicular on the perimeter edge surface. This embodiment is also visualized by FIG. 5. Preferably less than half the diameter of a hole is cut off, or if the hole is not circular preferably less than half of the hole width measured in a direction perpendicular on the perimeter edge of the security document precursor. This has the advantage that the coloured material cannot simply fall out, especially for holes that have a smaller dimension near the perimeter edge which is parallel with the perimeter edge.

In a preferred embodiment, holes of the security document precursor have been foreseen along the complete perimeter edge of the precursor. It is also possible to provide the holes only along one or two sides of the perimeter edge of the precursor.

A hole near the perimeter edge can be completely filled by one type of coloured material; alternatively several differently coloured materials may be used to fill the hole.

Figure 1:
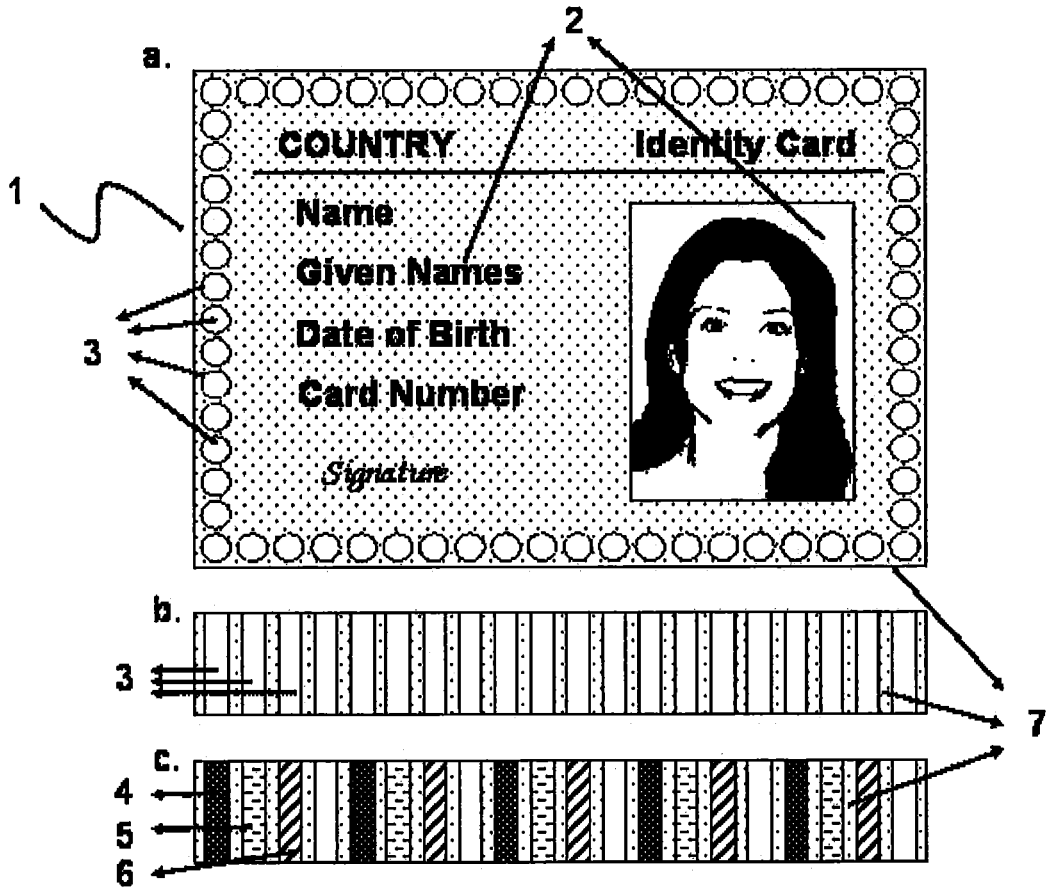

In a preferred embodiment of the security document precursor according to the present invention, at least two holes are filled with differently coloured material. This makes it possible to provide a multicoloured pattern visible along the perimeter edge. For example, as shown by part c. of FIG. 1, it is possible to use this in an identification card of a state wherein the coloured material in the two or more holes near one perimeter edge surface of the precursor correspond with some or all of the colours of the national flag of that state.

Figure 2:
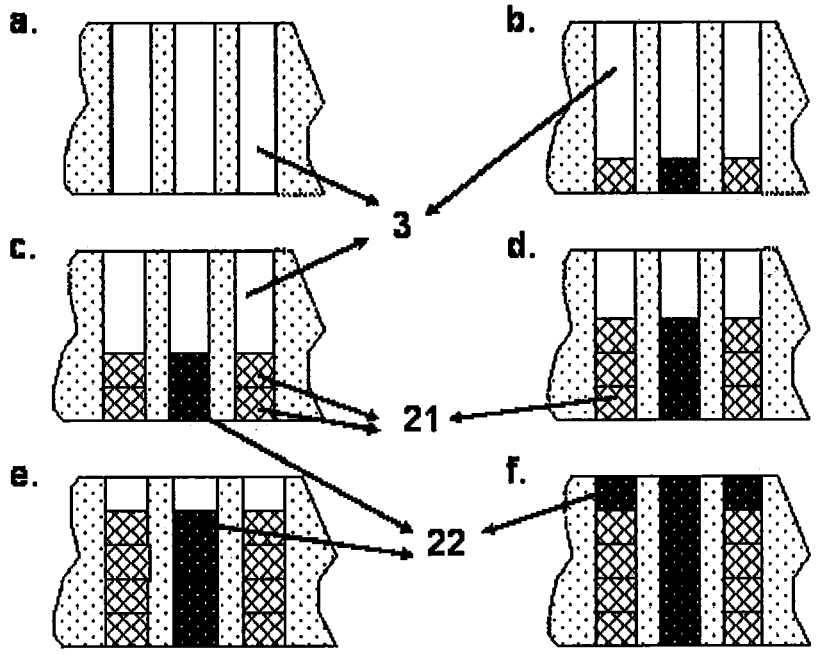
in FIG. 2 shows how each of the holes 3 of a security document precursor can be filled with differently coloured matters 21 and 22 to form the alphanumeric character "T".

In another preferred embodiment of the security document precursor according to the present invention, the holes can be filled up using two types of differently coloured materials 21 and 22 per hole as shown in FIG. 2, to form alphanumeric data readable from the perimeter edge surface of the precursor. FIG. 2 shows how each of the holes 3 of a security document precursor can be filled with differently coloured matters 21 and 22 to form the alphanumeric character "T". Part a. shows that the holes are empty. In part b. of FIG. 2, a light coloured matter, e.g. a white inkjet ink, has been added to the first and the third hole, while a dark coloured matter e.g. a black or a blue radiation curable inkjet ink, has been added to the hole in the middle. This is repeated in parts c. to e. of FIG. 2. To obtain the letter "T", the dark coloured matter is added to the three holes as shown in the last part f. of FIG. 2.

In a preferred embodiment of the security document precursor according to the present invention, at least one hole is filled with differently coloured materials.

Figure 4:
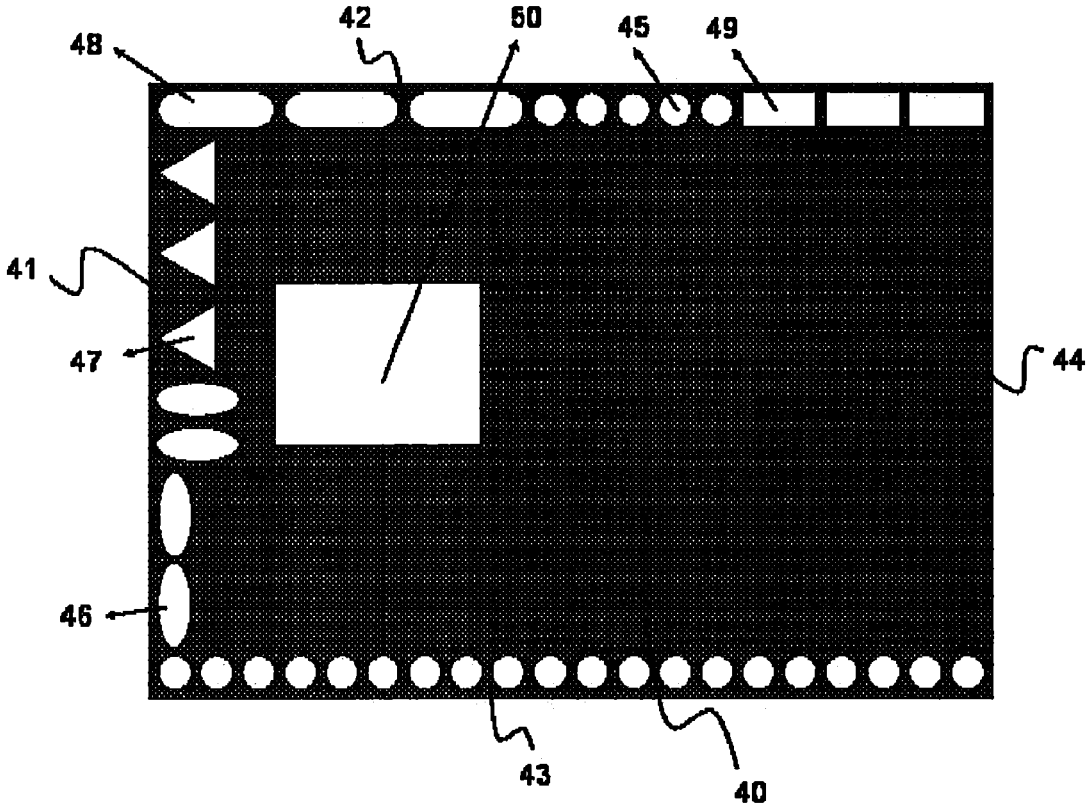
FIG. 4 shows the front view of a security document precursor 40 with four edges 41, 42, 43 and 44 containing different types of holes 45, 46, 47, 48 and 49 and a recess 50 for a chip.

The holes may have any desired shape and size. Preferred shapes of the holes are shown in security document precursor 40 of FIG. 4 and include circular 45, oval 46, triangular 47, elongated oval 48 and rectangular 49 shapes. While providing the holes to the security document precursor, at the same time a recess 50 may be provided for receiving a chip. Chips are incorporated in security cards to produce so-called smart cards. Smart cards include contact chips which can be read through physical contact in a card reader. Nowadays also contact less chips, known as RFID chips, are incorporated into smart cards. In the latter an antenna is connected with the chip. The security document precursor according to the present invention may contain a recess in one or more lamellae for containing a chip and/or antenna. In a preferred embodiment of the security document precursor according to the present invention, the security document precursor contains a chip and/or antenna.

There are no real limitations on the patterns which can be formed using one or more coloured materials. These patterns may include flags, company logo's, alphanumeric data, barcodes and the like. The patterns may be large enough to be visible by the human eye or may require some optical instrument, such as a magnifying glass or a microscope. The patterns may also be read by other types of equipment such as e.g. barcode readers or spectrophotometers when magnetic respectively e.g. infrared pigments are used to fill the holes.

A hole near the perimeter edge means preferably a hole of which the smallest distance between the edge of the hole and the edge of a lamella containing the hole is not more than 5 mm, more preferably not more than 2 mm and most preferably nort more than 1 mm.

Figure 3:
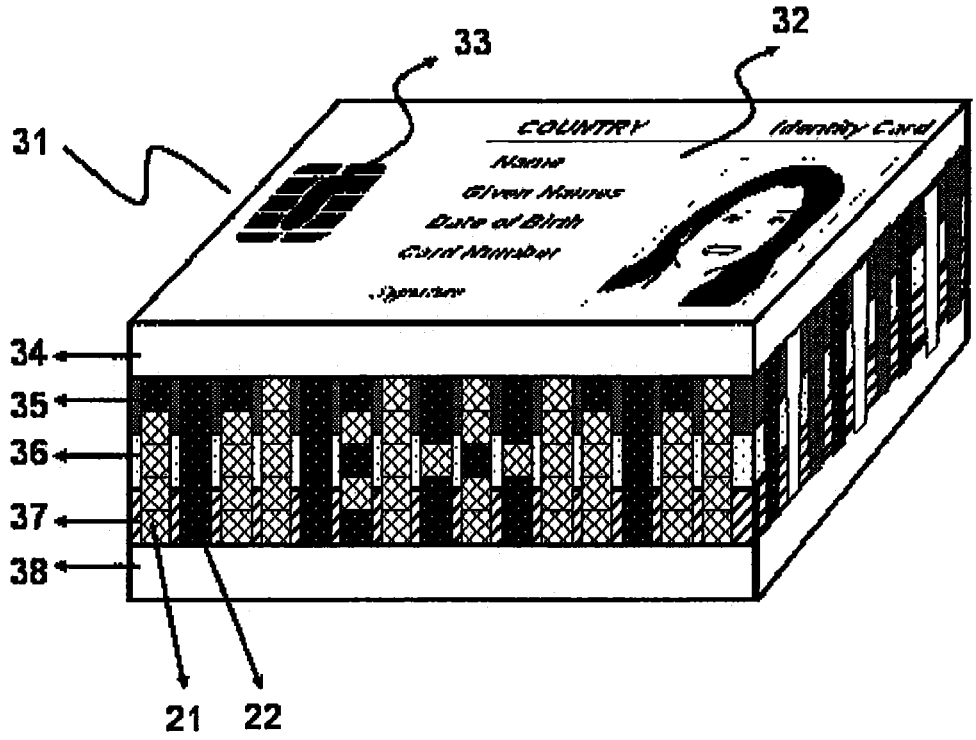
FIG. 3 shows a security document 31 containing a security document precursor of three lamellae 35, 36 and 37 laminated together to form a security laminate. The security laminate contains holes filled up with differently coloured matters 21 and 22 to form readable alphanumeric data visible on its perimeter edge. The security document further includes a backside lamella 38 and a front lamella 31, the front lamella 31 containing information 32 for identification of the card owner and a contact chip 33.

The security document precursor can be incorporated into a security document in any desirable manner. For example, the opening of the holes filled with one or more coloured matters may be covered by one or more additional layers and lamellae, as exemplified by the lamellae 34 and 38 in the security document 31 shown in FIG. 3. In FIG. 3, the holes are no longer visible from the front view which contains the information 2 for identification of the card owner. However, the front view may also show the top of the holes as, for example, in part a. of FIG. 1. The latter can be advantageously used for a further way of verifying the authenticity of a security document. The opening of the hole at the top can be made large enough to allow measurement of the absorption spectrum of the coloured matter used to fill the hole. Special coloured materials, such as e.g. ultraviolet or infrared absorbing colorants having no or minimal absorption in the visual spectrum (400-700 nm), can be used to give a characteristic spectrum for verification of the authenticity of the security document.

The security document according to the present invention is preferably an identification card selected from the group consisting of an identity card, a security card, a driver's license card, a social security card, a membership card, a time registration card, a bank card, a pay card and a credit card. In a preferred embodiment, the security document according to the present invention is a personal identity card.

The security document according to the present invention may be a "smart card", meaning an identification card incorporating an integrated circuit as a so-called electronic chip. In a preferred embodiment the security document is a so-called radio frequency identification card or RFID-card.

A large set of security cards is preferably prepared on a large carrier of information such as a web or sheet by a step and repeat process, after which the information carrier is cut into multiple items with the appropriate dimensions each representing a personal ID card, preferably according to the format specified by ISO/IEC 7810. ISO 7810 specifies three formats for identification cards: ID-1 with the dimensions 85.60 mm×53.98 mm, a thickness of 0.76 mm is specified in ISO 7813, as used for bank cards, credit cards, driving licenses and smart cards; ID-2 with the dimensions 105 mm×74 mm, as used in e.g. French and German identity cards, with typically a thickness of 0.76 mm; and ID-3 with the dimensions 125 mm×88 mm, as used for passports and visa's. When the security cards include one or more contact less integrated circuits then a larger thickness is tolerated, e.g. 3 mm according to ISO 14443-1.

Coloured Materials

The coloured materials used to fill the holes may be in a liquid or a solid form, but are preferably in a liquid form as this allows a more uniform filling of the hole. Liquid coloured materials are well known to one skilled in the art as inks.

The colorants used in inks may be dyes, pigments or a combination thereof. Organic and/or inorganic pigments may be used. The colorant is preferably a pigment or a polymeric dye, most preferably a pigment, since these colorants have a better light stability than dyes.

The colorants may be black, white, cyan, magenta, yellow, red, orange, violet, blue, green, brown, mixtures thereof, and the like.

In one embodiment of the security document precursor according to the present invention, the coloured materials used to fill the holes differ from white and black.

Suitable colour pigments may be chosen from those disclosed by HERBST, Willy, et al. Industrial Organic Pigments, Production, Properties, Applications. 3rd edition. Wiley—VCH, 2004. ISBN 3527305769.

Non-organic pigments may be used in the inks. Particular preferred pigments are C.I. Pigment Metal 1, 2 and 3. Illustrative examples of the inorganic pigments include red iron oxide (III), cadmium red, ultramarine blue, prussian blue, chromium oxide green, cobalt green, amber, titanium black and synthetic iron black.

The inks may be aqueous based or solvent based inks, but are preferably inks curable by UV radiation or e-beam, since they speed up the production of security document precursors. Radiation curable inks are generally cured by polymerization or crosslinking in a much shorter time than the drying time of aqueous based or solvent based inks.

In a preferred embodiment, the coloured material is an inkjet ink. This allows the use of inkjet print heads to inject the inkjet inks into the holes of the security document precursor in a well-controlled manner.

Pigment particles in inkjet inks should be sufficiently small to permit free flow of the ink through the inkjet-printing device, especially at the ejecting nozzles. It is also desirable to use small particles for maximum colour strength and to slow down sedimentation.

The numeric average pigment particle size is preferably between 0.050 and 1 μm, more preferably between 0.070 and 0.300 μm and particularly preferably between 0.080 and 0.200 μm. Most preferably, the numeric average pigment particle size is no larger than 0.150 μm. An average particle size smaller than 0.050 μm is less desirable for decreased light-fastness, but mainly also because very small pigment particles or individual pigment molecules thereof may still be extracted in food packaging applications. The average particle size of pigment particles is determined with a Brookhaven Instruments Particle Sizer B190plus based upon the principle of dynamic light scattering. The ink is diluted with ethyl acetate to a pigment concentration of 0.002 wt %. The measurement settings of the B190plus are: 5 runs at 23° C., angle of 90°, wavelength of 635 nm and graphics=correction function.

However for a white ink, the numeric average particle diameter of the white pigment is preferably from 50 to 500 nm, more preferably from 150 to 400 nm, and most preferably from 200 to 350 nm. Sufficient hiding power cannot be obtained when the average diameter is less than 50 nm, and the storage ability and the jet-out suitability of the ink tend to be degraded when the average diameter exceeds 500 nm. The determination of the numeric average particle diameter is best performed by photon correlation spectroscopy at a wavelength of 633 nm with a 4 mW HeNe laser on a diluted sample of the pigmented ink. A suitable particle size analyzer used was a Malvern™ nano-S available from Goffin-Meyvis. A sample can be, for example, be prepared by addition of one drop of ink to a cuvette containing 1.5 mL ethyl acetate and mixed until a homogenous sample was obtained. The measured particle size is the average value of 3 consecutive measurements consisting of 6 runs of 20 seconds.

Suitable white pigments are given by Table 2 in [0116] of WO 2008/074548 (AGFA GRAPHICS). The white pigment is preferably a pigment with a refractive index greater than 1.60. The white pigments may be employed singly or in combination. Preferably titanium dioxide is used as pigment with a refractive index greater than 1.60. Suitable titanium dioxide pigments are those disclosed in [0117] and in [0118] of WO 2008/074548 (AGFA GRAPHICS).

Special colorants may be used alone or in combination with other colorants in the coloured matter and include ultraviolet or infrared absorbing dyes and pigments, fluorescent and phosphorescent dyes and pigments or coloured magnetic particles.

The pigments are preferably present in the range of 0.01 to 10% by weight, preferably in the range of 0.1 to 5% by weight, each based on the total weight of the ink. For white radiation curable inks, the white pigment is preferably present in an amount of 3% to 30% by weight of the ink composition, and more preferably 5% to 25%. An amount of less than 3% by weight cannot achieve sufficient covering power and usually exhibits very poor storage stability and ejection property.

Generally pigments are stabilized in the dispersion medium by dispersing agents, such as polymeric dispersants. However, the surface of the pigments can be modified to obtain so-called "self-dispersible" or "self-dispersing" pigments, i.e. pigments that are dispersible in the dispersion medium without dispersants.

In addition to one or more coloured materials for filling the holes, a non-coloured material, e.g. a colourless ink, may be used in the security document precursor according to the present invention. Such a colourless ink is preferably a colourless inkjet ink, more preferably a radiation curable inkjet ink such as e.g. a UV curable inkjet ink comprising a photoinitiator and one or more monomers and oligomers but lacking a colorant.

Lamellae and Layers

Any lamella or layer used for preparation of security documents may be used in the security document precursor according to the present invention as long as they allow the application of holes near their perimeter edge.

When more than one lamella is used, the lamellae may all be made of the same materials or alternatively a mix of lamellae may be used made from different materials, e.g. a polyester lamella and a PVC lamella.

In a preferred embodiment of the security document precursor according to the present invention, at least one of the lamellae is a polyester lamella, more preferably a linear polyester lamella and most preferably a biaxially stretched polyethylene terephthalate lamella. Polyester lamella, and especially biaxially stretched polyethylene terephthalate lamellae have high mechanical strength and dimensional stability and are chemically inert against many organic solvents contrary to e.g. polycarbonate lamellae.

A linear polyester is well known to those skilled in the art and is obtained by condensing one or more dicarboxylic acids or their lower (up to 6 carbon atoms) diesters, e.g., terephthalic acid, isophthalic acid, phthalic acid, 2,5-, 2,6- or 2,7-naphthalenedicarboxylic acid, succinic acid, sebacic acid, adipic acid, azelaic acid, 4,4'-diphenyldicarboxylic acid, hexahydroterephthalic acid or 2-bis-p-carboxyphenoxyethane (optionally with a monocarboxylic acid, such as pivalic acid), the corresponding dicarboxylic acid dialkyl ester or lower alkyl ester with one or more glycols, e.g., ethylene glycol, 1,3-propanediol, 1,4-butanediol, neopentyl glycol and 1,4-cyclohexanedimethanol. In a preferred embodiment, the polyester polymer is obtained by condensing terephthalic acid or 2,6-naphthalenedicarboxylic acid or their dimethyl esters with ethylene glycol. In another preferred embodiment, the polymer is PET. The PET film prepared from the above-described composition is preferably oriented. In a preferred embodiment, the PET film is biaxially-oriented. Such a process is well known to those skilled in the art and described in many patents, such as GB 838708 (ICI), the disclosure of which is hereby incorporated by reference.

In a preferred embodiment of the invention, the polyester is an orientable polyester with polyesters comprising monomer units selected from the group consisting of terephthalate units, isophthalate units, naphthalate units, ethylene units, neopentylene units, 1,4-cyclohexane dimethylene units and —$CH_2CH_2OCH_2CH_2$— units being preferred, e.g. polyethylene terephthalate (PET), polyethylene naphthalate (PEN).

The lamella may be white or coloured. The colouring and making of polyester lamellae, such as PET lamellae, is well known to the skilled person. Colouring is preferably performed using dyes as colorants. A single dye or a mixture of dyes can be used to obtain coloured polyester lamellae. For example, US 2008318073 discloses how to prepare a biaxially oriented polyester film containing a yellow anthraquinone dye and a red perinone dye.

The preparing of a blue lamella is exemplified in U.S. Pat. No. 3,918,976 (FUJI PHOTO FILM) for obtaining blue coloured X-ray photographic film supports by employing one or more anthraquinone dyes.

The thickness of the polymeric lamella employed in the present invention is preferably between 50 μm and 250 μm.

In a preferred embodiment, one or both sides of the lamella have been foreseen by an adhesion system. The adhesion system may consist out of a single layer. Adhesive materials that are currently in use are preferably formulations prepared on the basis of polyurethanes, polyesters or polyamides and/or their copolymers. In particular thermoplastic adhesive formulations are used. A cross-linking of these thermoplastic adhesive materials by way of subjecting them to high-energy radiation is a known method.

Particularly suitable adhesion systems are also disclosed US 2004007324 (SAGEM ORGA) and WO 2009/063058 (AGFA GEVAERT).

The lamellae used in the security document precursor or the security document according to the present invention may include one or more additional layers such as subbing layers, adhesion layers, magnetic layers, protective layers, layers containing an image or image receiving layers, e.g. inkjet receiving layers.

Methods of Preparing Security Document Precursors

The method for preparing a security document precursor according to the present invention comprises the steps of:

a) providing a security document precursor including one or more lamellae;

b) applying two or more holes near a perimeter edge surface of the precursor;

c) adding coloured material into at least one of the holes.

The two or more holes near a perimeter edge surface of the precursor may be applied by any suitable manner known to the skilled person.

A preferred manner for applying two or more holes near a perimeter edge surface of the precursor is by mechanically drilling the holes into the one or more transparent or translucent lamellae. The holes may be made by drilling, but are preferably made using a laser since this provides for a higher accuracy and the diameter and shape of the holes can be varied more easily.

Suitable laser include lasers selected from the group consisting of a Nd:YAG laser and a $CO_2$-laser.

Suitable commercially available lasers include the high-power $CO_2$-lasers from ROFIN and the $CO_2$-laser used in a CardMasterOne™ from Industrial Automation Integrators b.v.

A combination of several methods, such as e.g. drilling and lasering, for applying the two or more holes near a perimeter edge surface of the precursor may also be employed.

The holes can be applied at the manufacturing site of the security document precursor and filled with the coloured matters as desired by the customers. Alternatively, the holes can also be filled with the coloured matters at the location of the security document issuer. This is necessary if the coloured matters are varied per security document. For example, it is possible to include variable alphanumeric data, e.g. the name of a security card owner, as information visible from the perimeter edge surface.

The coloured material may be added to the holes in any suitable manner, e.g. using a set of injection needles connected to one or more reservoirs of coloured material. In a preferred embodiment of the method for preparing a security document precursor according to the present invention, the coloured material in step c) is added using an inkjet print head.

Other Security Features

To prevent forgeries of identification documents, different means of securing may be used.

The security document according to the present invention may contain other security features such as anti-copy patterns, guilloches, endless text, miniprint, microprint, nanoprint, rainbow colouring, 1D-barcode, 2D-barcode, coloured fibres, fluorescent fibres and planchettes, fluorescent pigments, OVD and DOVID (such as holograms, 2D and 3D holograms, Kinegrams™, overprint, relief embossing, perforations, metallic pigments, magnetic material, Metamora colours, microchips, RFID chips, images made with OVI (Optically Variable Ink) such as iridescent and photochromic ink, images made with thermochromic ink, phosphorescent pigments and dyes, watermarks including duotone and multitone watermarks, ghost images and security threads.

A combination with one of the above security features increases the difficulty for falsifying a security document.

EXAMPLE

This example illustrates how a security document precursor in accordance with the present invention can be prepared.

Materials

PETG500 is a 500 μm thick white foil of PETG foil available from Folienwerk Wolfen GmbH under the trade name of Pet-G.

PETG100 is a 100 μm thick white foil of PETG foil available from Folienwerk Wolfen GmbH under the trade name of Pet-G.

Preparation of Security Document Precursor SDP-1

In an opaque PETG500 foil, several holes having a diameter varying from 500 μm to 2 mm were drilled in a straight line divided by a distance of 600 μm from each other and at a distance of 1 mm from the perimeter edge. After one side of the drilled PETG500 foil was glued to a temporary foil, the holes were filled with the cyan, magenta, yellow and black UV curable inkjet inks from an ANAPURNA™ XLS Inkjet inkset G1. The inks in the holes of the PETG500 foil were cured using a Fusion DRSE-120 conveyer, equipped with a Fusion VPS/I600 lamp (D-bulb), which transported the foil under the UV-lamp on a conveyer belt at a speed of 20 m/min. The temporary foil glued to the PETG500 foil was removed. In order to obtain the security document precursor SDP-1, on both sides of the PETG500 foil, a PETG100 foil was laminated using a GMP Excellam™ 655Q hot roll laminator. The GMP Excellam™ 655Q hot roll laminator was set at a lamination temperature of 160° C., a distance of 1 mm between the rolls, a speed setting of 1 and inserting the laminates protected between a silicon based paper (Codor-carrier N° 57001310 from CODOR) to prevent sticking to laminator rolls.

Evaluation

Although for a similar security document precursor containing only transparent lamellae the colored holes were clearly visible from a direction perpendicular on the perimeter edge surface, this was not the case for the security document precursor SDP-1 containing opaque lamellae.

Using a Stanley cutter, a bit more than 1 mm was cut off from the perimeter edge where the colored holes were located. The security document precursor SDP-1 then exhibited colored lines visible from a direction perpendicular on the perimeter edge surface.

The invention claimed is:

1. A security document precursor including two or more lamellae provided with two or more holes near a perimeter edge surface of the precursor, wherein the holes perforate the largest surfaces of the two or more lamellae, and wherein at least two of the holes are filled with differently coloured materials which differ in colour from at least two of the lamellae, such that the coloured materials form alphanumeric data and are visible from a direction perpendicular on the perimeter edge surface;

wherein at least one of the lamellae is transparent or translucent: or wherein at least one of the lamellae is opaque and the opaque part of the at least one of the lamellae between the perimeter edge and the hole filled with a coloured material has been removed.

2. The security document precursor according to claim 1 further containing a recess in one or more lamellae for containing a chip and/or antenna.

3. The security document precursor according to claim 2 containing a chip and/or antenna.

4. A security document comprising the security document precursor according to claim 3.

5. A security document comprising the security document precursor according to claim 2.

6. The security document precursor according to claim 1 wherein at least one of the lamellae is a polyester lamella.

7. The security document precursor according to claim 6 wherein the polyester lamella is a biaxially stretched polyethylene terephthalate lamella.

8. A security document comprising the security document precursor according to claim 7.

9. The security document precursor according to claim 1 being an identification card of a state wherein the coloured materials in the two or more holes near one perimeter edge surface of the precursor correspond with some or all of the colours of the national flag of that state.

10. A security document comprising the security document precursor according to claim 9.

11. A security document comprising the security document precursor according to claim 1.

12. A method of preparing a security document precursor as defined by claim 1 comprising the steps of:

a) providing two or more lamellae wherein at least one of the lamellae is transparent or translucent, or wherein at least one of the lamellae is opaque;

b) applying two or more holes near a perimeter edge surface of the two or more lamellae, the holes perforating the largest surfaces of the two or more lamellae;

c) adding differently coloured materials into at least two of the holes, said coloured materials differing in colour from said two or more lamellae such that the coloured materials form readable alphanumeric data and are visible from a direction perpendicular on the perimeter edge surface; and d) if the at least one of the lamellae is opaque, removing the opaque part of the at least one of the lamellae between the perimeter edge and the hole or holes with the added coloured material.

13. The method according to claim 12 wherein the holes in step b) are applied by a laser.

14. The method according to claim 13 wherein the coloured materials in step c) are added by an inkjet print head.

15. The method according to claim 12 wherein the coloured materials in step c) are added by an inkjet print head.

* * * * *